US006266638B1

(12) United States Patent
Stylianou

(10) Patent No.: US 6,266,638 B1
(45) Date of Patent: Jul. 24, 2001

(54) VOICE QUALITY COMPENSATION SYSTEM FOR SPEECH SYNTHESIS BASED ON UNIT-SELECTION SPEECH DATABASE

(75) Inventor: Ioannis G. Stylianou, Madison, NJ (US)

(73) Assignee: AT&T Corp, New York, NY (US)

( * ) Notice: Subject to any disclaimer, the term of this patent is extended or adjusted under 35 U.S.C. 154(b) by 0 days.

(21) Appl. No.: 09/281,022

(22) Filed: Mar. 30, 1999

(51) Int. Cl.[7] ..... G10L 13/06
(52) U.S. Cl. ..... 704/266; 704/267
(58) Field of Search ..... 704/260, 258, 704/256, 255, 269, 266, 200, 201, 233, 234, 240, 267, 268

(56) References Cited

U.S. PATENT DOCUMENTS

| | | | | |
|---|---|---|---|---|
| 4,624,012 | * | 11/1986 | Lin et al. | 704/261 |
| 4,718,094 | * | 1/1988 | Bahl et al. | 704/256 |
| 5,271,088 | * | 12/1993 | Bahler | 704/200 |
| 5,689,616 | * | 11/1997 | Li | 704/232 |
| 5,860,064 | * | 1/1999 | Henton | 704/260 |
| 5,913,188 | * | 6/1999 | Tzirkel-Hancock | 704/223 |
| 6,144,939 | * | 11/2000 | Parson et al. | 704/258 |
| 6,163,768 | * | 12/2000 | Sherwood et al. | 704/235 |

OTHER PUBLICATIONS

S. Kay, Fundamentals of Statistical Signal Processing: Estimation Theory, Prentice Hall, p. 198, No date.

Dempster et al, Maximum Likelihood from Incomplete Data, Royal Statistical Society meeting, Dec. 8, 1979, pp. 1–38.

* cited by examiner

*Primary Examiner*—Richemond Dorvil

(57) ABSTRACT

A database of recorded speech units that consists of a number of recording sessions is processed, and appropriate segments are modified by passing the signal of those segments through an AR filter. The processing develops a Gaussian Mixture Model (GMM) for each recording session and, based on variability of the speech quality within a session, based on its model, one session selected as the preferred sessions. Thereafter, all segments of all recording sessions are evaluated based on the model of the preferred session. An assessment of the difference between the average power spectral density of each evaluated segment is compared to the power spectral density of the preferred session, and from this comparison, AR filter coefficients are derived for each segment so that, when the speech segment is passed through the AR filter, its power spectral density approaches that of the preferred session.

20 Claims, 2 Drawing Sheets

VOICE QUALITY COMPENSATION SYSTEM FOR SPEECH SYNTHESIS BASED ON UNIT-SELECTION SPEECH DATABASE

BACKGROUND

This relates to speech synthesis and, more particularly, to databases from which sound units are obtained to synthesize speech.

While good quality speech synthesis is attainable using concatenation of a small set of controlled units (e.g. diphones), the availability of large speech databases permits a text-to-speech system to more easily synthesize natural sounding voices. When employing an approach known as unit selection, the available large variety of basic units with different prosodic characteristics and spectral variations reduces, or entirely eliminates, the prosodic modifications that the text-to-speech system may need to carry out. By removing the necessity of extended prosodic modifications, a higher naturalness of the synthetic speech is achieved.

While having many different instances for each basic unit is strongly desired, a variable voice quality is not. If it exists, it will not only make the concatenation task more difficult but also will result in a synthetic speech with changing voice quality even within the same sentence. Depending on the variability of the voice quality of the database, a synthetic sentence can be perceived as being "rough," even if a smoothing algorithm is used at each concatenation instant, and even perhaps as if different speakers utter various parts of the sentence. In short, inconsistencies in voice quality within the same unit-selection speech database can degrade the overall quality of the synthesis. Of course, the unit selection procedure can be made highly discriminative to disallow mismatches in voice quality but, then, the synthesizer will only use part of the database, while time (and money) was invested to make the complete database available (recording, phonetic labeling, prosodic labeling, etc.).

Recording large speech databases for speech synthesis is a very long process, ranging from many days to months. The duration of each recording session can be as long as 5 hours (including breaks, instructions, etc.) and the time between recording sessions can be more than a week. Thus, the probability of variations in voice quality from one recording session to another (inter-session variability) as well as during the same recording session (intra-session variability) is high.

The detection of voice quality differences in the database is a difficult task because the database is large. A listener has to remember the quality of the voice from different recording sessions, not to mention the shear time that checking a complete store of recordings would take.

The problem of assessing voice quality and its correction have some similarity to speaker adaptation problems in speech recognition. In the latter, "data oriented" compensation techniques have been proposed that attempt to filter noisy speech feature vectors to produce "clean" speech feature vectors. However, in the recognition problem, it is the recognition score that is of interest, regardless of whether the adapted speech feature vector really matches that of "clean" speech or not.

The above discussion clearly shows the difficulty of our problem: not only is automatic detection of quality desired, but any modification or correction of the signal has to result in speech of very high quality. Otherwise the overall attempt to correct the database has no meaning for speech synthesis. While consistency of voice quality in a unit-selection speech database is, therefore, important for high-quality speech synthesis, no method for automatic voice quality assessment and correction has been proposed yet.

SUMMARY

To increase naturalness of concatenative speech synthesis, a database of recorded speech units that consists of a number of recording sessions is processed, and appropriate segments of the sessions are modified by passing the signal of those sessions through an AR filter. The processing develops a Gaussian Mixture Model (GMM) for each recording session and, based on variability of the speech quality within a session, based on its model, one session is selected as the preferred session. Thereafter, all segments of all recording sessions are evaluated based on the model of the preferred session. An assessment of the difference between the average power spectral density of each evaluated segment is compared to the power spectral density of the preferred session, and from this comparison, AR filter coefficients are derived for each segment so that, when the speech segment is passed through the AR filter, its power spectral density approaches that of the preferred session.

DETAILED DESCRIPTION

A Gaussian Mixture Model (GMM) is a parametric model that has been successfully applied to speaker identification. It can be derived by taking a recorded speech session, dividing it into frames (small time intervals, e.g., 10 msec) of the speech, and for each frame, i, ascertaining a set of selected parameters, $o_i$, such as a set of q cepstrum coefficients, that can be derived from the frame. The set can be viewed as a q-element vector, or as a point in q-dimensional space. The observation at each frame is but a sample of a random signal with a Gaussian distribution. A Gaussian mixture density assumes that the probability distribution of the observed parameters (q cepstrum coefficients) is a sum of Gaussian probability densities $p(o_i|\lambda_i)$, from M different classes, $(\lambda_i)$, having a mean vector $\mu_i$ and covariance matrix $\Sigma_i$, that appear in the observations with statistical frequencies $\alpha_i$. That is, the Gaussian mixture probability density, is given by the equation $$p(O \mid \Lambda) = \sum_{i=1}^{M} \alpha_i p(o_i \mid \lambda_i). \tag{1}$$

The complete Gaussian mixture density is represented by the model, $$\Lambda=\{\lambda_i\}=\{\alpha_i,\mu_i,\Sigma_i\} \text{ for } i=1, \ldots ,M, \tag{2}$$

where the parameters $\{\alpha_i,\mu_i,\Sigma_i\}$ are the unknowns that need to be determined.

Turning attention to the corpus of recorded speech, as a general proposition it is assumed that the corpus of recorded speech consists of N different recording sessions, $r_n$,n=1, . . . N. One of the sessions can be considered the session with the best voice quality, and that session may be denoted by $r_p$. Prior to the analysis disclosed herein, the identity of the preferred recording session (i.e., the value of p) is not known.

Figure 1:
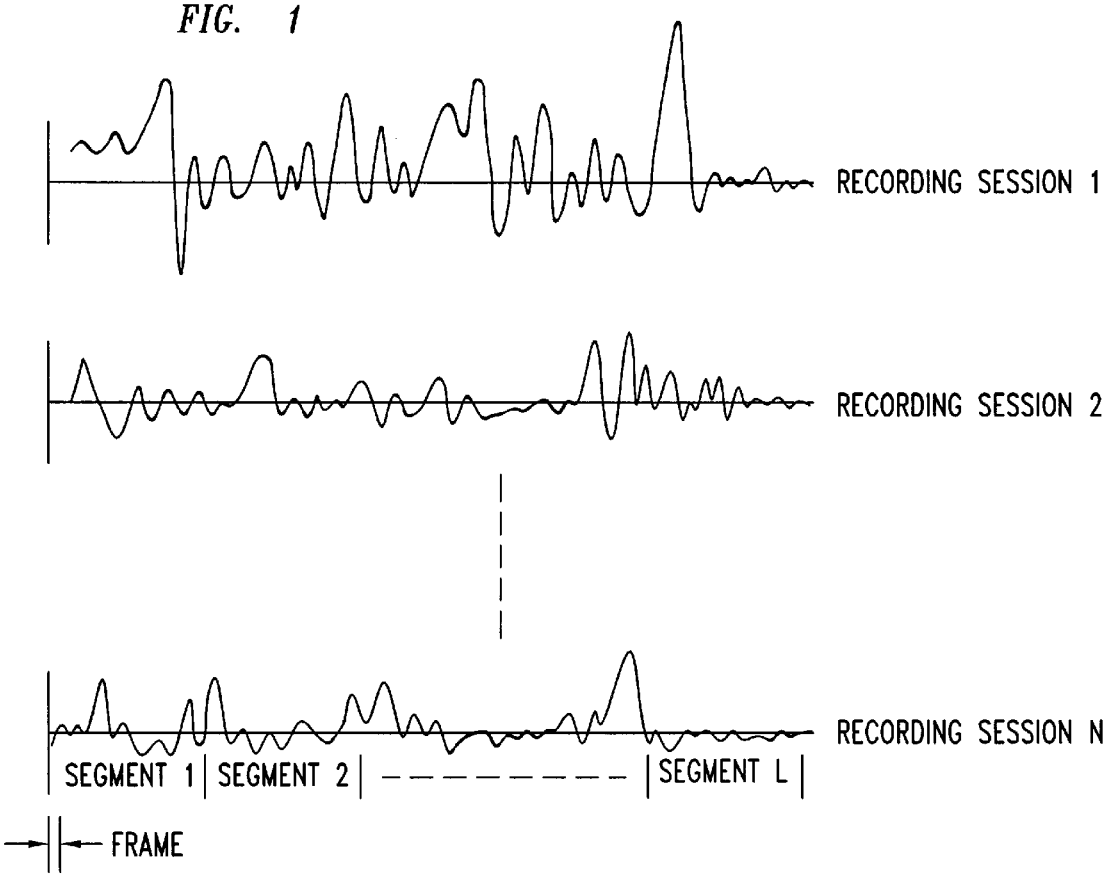
FIG. 1 shows a number of recorded speech sessions, with each session divided into segments.

To perform the analysis that would select the speech model against which the recorded speech in the entire corpus is compared, the different recording sessions are divided into segments, and each segment includes T frames. This is illustrated in FIG. 1. A flowchart of the process for deriving the preferred model for the entire corpus is shown in FIG. 2.

Figure 2:
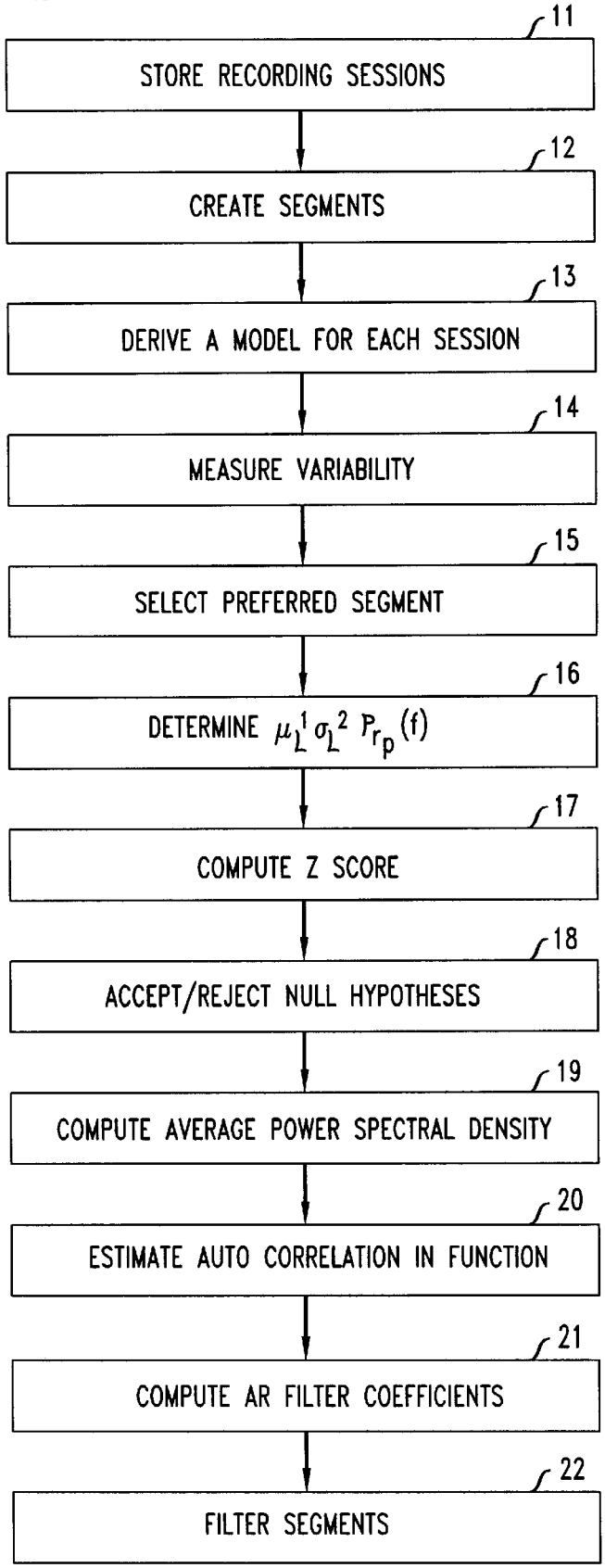
FIG. 2 presents a flow chart of the speech quality correction process of this invention.

Thus, as depicted in FIG. 2, block 11 divides the stored, recorded, speech corpus into its component recording sessions, and block 12 divides the sessions into segments of equal duration. When a recorded session is separated into L segments, it can be said that the observed parameters of a session, $O_{r_i}$ is a collection of observations from the L segments of the recorded session; i.e., $$O_{r_i}=[O_{r_i}^{(1)},O_{r_i}^{(2)},\ldots,O_{r_i}^{(k)},O_{r_i}^{(k+1)},\ldots,O_{r_i}^{(L)}], \tag{3}$$

where the observations of each of the segments are expressible as a collection of observation vectors; one from each frame. Thus, the $l^{th}$ set of observations, $O_{r_i}^{(l)}$, comprises T observation vectors, i.e., $O_{r_i}^{(l)}=(o_1^{(l)}o_2^{(l)}\ldots o_T^{(l)})$.

The number of unknown parameters of GMM, $\Lambda_{r_p}$, is (1+q+q)M. Hence, those parameters can be estimated from the first k>(2q+1) M observations $[O_{r_p}^{(1)},O_{r_p}^{(2)},\ldots,O_{r_p}^{(k)}]$ using, for example, the Expectation-Maximization algorithm. Illustratively, for q=16 and M=64, at the very least 2112 vectors (observations) should be in the first k segments. In practical embodiments, a segment might be 3 minutes long, and each observation (frame) might be 10 msec long. We have typically used between 3 and four segments (about 10 minutes of speech) for getting a good estimate of the parameters. The Expectation-Maximization algorithm is a well known, as described, for example, in A. P. Dempster, N. M. Laird, and D. B. Rubin, "Maximum likelihood from incomplete data via the EM algorithm," *J. Royal Statis. Soc. Ser. B (methodological)*, vol. 39, no. 1, pp, 1–22 and 22–38 (discussion), 1977. In accordance with the instant disclosure, a model is derived for each recording session from the first k (e.g. 3) segments of each session. This is performed in block 13 of FIG. 2.

Having created a model based on the first k segments from the collection of L segments of a recorded session, one can evaluate the likelihood that the observations in segment k+1 are generated from the developed model. If the likelihood is high, then it can be said that the observations in segment k+1 are consistent with the developed model and represent speech of the same quality. If the likelihood is low, then the conclusion is that the segment k+1 is not closely related to the model and represents speech of different quality. This is achieved in block 14 of FIG. 2 where, for each session, a measure of variability in the voice quality is evaluated for the entire session, based on the model derived from the first k segments of the session, through the use of a log likelihood function for model $\Lambda_{r_i}$, defined by $$\mathcal{L}(O_{r_i}^{(l)}\mid\Lambda_{r_i})=\frac{1}{T}\sum_{t=1}^{T}p(o_t^{(l)}\mid\Lambda_{r_i}). \tag{4}$$

Figure 3:
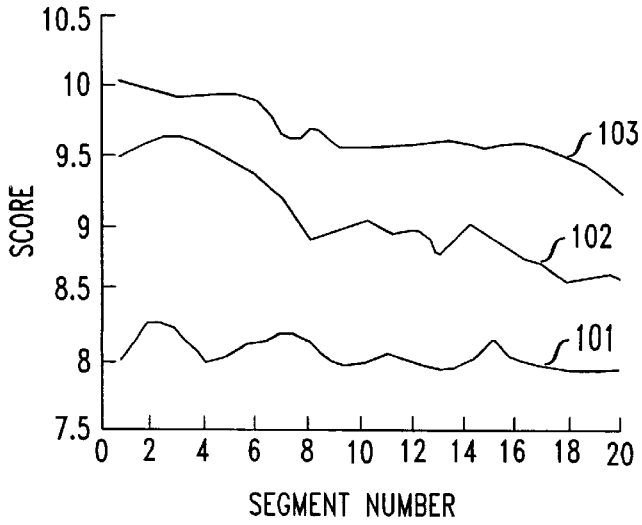
FIG. 3 is a plot of the speech quality of three sessions, as a function of segment number.

Equation (4) provides a measure of how likely it is that the model $\Lambda_{r_i}$ has produced the set of observed samples. Using equation (4) to derive (and, for example, plot) estimates $\zeta$ for l=1, . . . L, where $p(o_f^{(l)}|\Lambda_{r_i})$ is given by equation (1), block 14 determines the variability in voice quality of a recording session. FIG. 3 illustrates the variability of voice quality of three different sessions (plots 101, 102, and 103) as a function of segment number.

In accordance with the principles employed herein, a session whose model has the least voice quality variance (e.g., plot 101) is chosen as corresponding to the preferred recording session, because it represents speech with a relatively constant quality. This is accomplished in block 15.

Having selected a preferred recording session, the value of p is known and, henceforth, every other segment in the preferred recording session and in the other recording sessions is compared to the model $\Lambda_{r_p}$ that was derived from the first k segments of $r_p$. Upper and lower bounds for the log likelihood function, $\zeta$, can be obtained for the preferred session, and the distribution of $\zeta$ for the entire $r_p$ is approximated with a uni-modal Gaussian with mean $\mu_\zeta$ and variance $\sigma_\zeta^2$. The values of mean $\mu_\zeta$ and variance $\sigma_\zeta^2$ are computed in block 16.

In accordance with the principles disclosed herein, voice quality problems in segments of the non-preferred recorded sessions, as well as in segments of the preferred recorded session, are detected by setting up and testing a null hypothesis. The null hypothesis selected, denoted by $H_0$:$r_p$~$r_i$(l), asserts that the $l^{th}$ observation from $r_i$ corresponds to the same voice quality as in the preferred session $r_p$. The alternative hypothesis, denoted by $H_0$:$r_p$!~$r_i$(l), asserts that the $l^{th}$ observation from $r_i$ corresponds to a different voice quality from that in the preferred session, $r_p$.. The null hypothesis is accepted when the z score, defined by $$z_{r_i}^{l}=\frac{\mathcal{L}(O_{r_i}^{(l)}\mid\Lambda_{r_p})-\mu_{\mathcal{L}}}{\sigma_{\mathcal{L}}}, \tag{5}$$

is not more than 2.5758, which indicates that the likelihood of erroneously accepting the null hypothesis is not more than 0.01. Hence, block 17 evaluates equation (5) for each segment in the entire corpus of recorded speech (save for the first k segments of $r_p$).

To summarize, the statistic decision is:

Null hypothesis $H_0$:$r_p$~$r_i$(l)

Alternative hypothesis: $H_1$:$r_p$!~$r_i$(l)

Reject $H_0$: significant at level 0.01 (z=2.5758)

The determination of whether the null hypothesis for a segment is accepted or rejected is made in block 18.

To equalize the voice quality of the entire corpus of recorded speech data, for each segment in the N recorded sessions where the hypothesis $H_0$ is rejected, a corrective filtering is performed.

While the characteristics of unvoiced speech differ from those of voiced speech, it is reasonable to use the same correction filter for both cases. This is motivated by the fact that the system tries to detect and correct average differences in voice quality. For some causes for differences in voice quality, such as different microphone positions, the imparted change in voice quality is identical for voiced and unvoiced sounds. In other cases, for example, when the speaker fatigues at the end of a recording session, voiced and unvoiced sounds might be affected in different ways. However, estimating two corrective filters, one for voiced and one for unvoiced sounds would result in degradation of the corrected speech signals whenever a wrong voiced/unvoiced decision is made. Therefore, at least in some embodiments it is better to employ only one corrective filter.

The filtering is performed by passing the signal of a segment to be corrected through an autoregressive corrective filter of order j. The j coefficients are derived from an autocorrelation function of a signal that corresponds to the difference between the average power spectrum density of the preferred session and the average power density of the segment that is to be filtered.

Accordingly, the average power spectral density (psd) from the preferred session is estimated first, using a modified periodogram, $$(\mathcal{P})_{r_p}(f) = \frac{1}{\|w\|^2 K}\sum_{t=1}^{K} P_t^{(l)}(f) \tag{6}$$

where w is a hamming window, K is the number of speech frames extracted from the preferred session over which the average is computed, and $P_i^{(l)}(f)$, which is the power density in segment l, is given by $$P_t^{(l)}(f) = \left|\sum_{n=0}^{N-1} w(n)s_t(n)\exp(-j2\pi fn)\right|^2 \tag{7}$$

where $s_t$ is a speech frame from the $l^{th}$ observation sequence at time t. The computation of $\mathcal{P}_{r_p}(f)$ takes place only once and, therefore, FIG. 2 shows this computation to be taking place in block 16.

Corresponding to $\mathcal{P}_{r_p}(f)$, $\mathcal{P}_{r_i}^{(l)}(f)$ denotes the average power spectral density of the $l^{th}$ sequence from the recording session $r_i$, and it is estimated for the segments where hypothesis $H_0$ is rejected. This is evaluated in block 19 of FIG. 2. The autocorrelation function, $\rho_{r_i}^{(l)}(\tau)$, is estimated by $$\rho_{r_i}^{(l)}(\tau) = \int_{-1/2}^{1/2}\left((\mathcal{P})_{r_p}(f) - (\mathcal{P})_{r_i}^{(l)}(f)\right)\exp(j2\pi f\tau)df \tag{8}$$

in block 20, where samples $\rho_{r_i}^{(l)}[\tau]$ for $\tau$=0,1, . . . ,j are developed, and block 21 computes j coefficients of an AR (autoregressive) corrective filter of order j (well known filter having only poles in the z domain) from samples developed in block 20. The set of j coefficients may be determined by solving a set of j linear equations as taught, for example, by S. M. Kay, "Fundamentals of Statistical Signal Processing: Estimation Theory," *PH Signals processing Series*, Prentice Hall. (Yule-Walker equations).

Finally, with the AR filter coefficients determined, the segments to be corrected are passed through the AR filer and back into storage. This is accomplished in block 22.

I claim:

1. A method for improving quality of stored speech units comprising the steps of:

separating said stored speech units into sessions;

separating each session into segments;

analyzing each session to develop a speech model for the session;

selecting a preferred session based on the speech model for the session developed in said step of analyzing and said stored speech for the session;

identifying, by employing the speech model of said preferred session, said speech model being a preferred speech model, those of said segments that need to be altered; and altering those of said segments that are identified by said step of identifying.

2. The method of claim 1 where the segments are approximately the same duration.

3. The method of claim 1 where said step of altering comprises the steps of:

developing filter parameters for a segment that needs to be altered; and passing the speech units signal of said segment that needs to be altered through a filter that employs said filter parameters.

4. The method of claim 3 where said filter is an AR filter.

5. The method of claim 1 where said step of analyzing a session to develop a speech model for the session comprises the steps of:

selecting a sufficient number of segments from said session to form a speech portion of approximately ten minutes; and developing a speech model for said session based on the segments selected in said step of selecting.

6. The method of claim 5 where said model is a Gaussian Mixture Model.

7. The method of claim 1 where said step of analyzing a session to develop a speech model for the session comprises the steps of:

selecting a number of segments, K, from said session, where K is greater than a preselected number, where each segment includes a plurality of observations;

developing speech parameters for each of said plurality of observations; and developing a speech model for said session based on said speech parameters developed for observations in said selected segments of said session.

8. The method of claim 7 where said speech parameters are cepstrum coefficients.

9. The method of claim 1 where said step of selecting a preferred speech model comprises the steps of:

developing a measure of speech quality variability within each session based on the speech model developed for the session by said step of analyzing; and selecting as the preferred model the speech model of the session with the least speech quality variability.

10. The method of claim 1 where said step of identifying segments that need to be altered comprises the steps of:

testing each of said segments against the hypothesis that the speech units in said segment conform to said preferred speech model.

11. The method of claim 10 where the hypothesis is accepted for a segment tested in said step of testing when the likelihood that a speech model that generated the speech units in the segment is said preferred speech model is higher than a preselected threshold level.

12. The method of claim 10 where the hypothesis is accepted for a segment tested in said step of testing when a z score for the segment tested in said step of testing, $z_{r_i}^{l}$, is greater than a preselected level, where $$z_{r_i}^{l} = \frac{\mathcal{L}(O_{r_i}^{(l)} \mid \Lambda_{r_p}) - \mu_{\mathcal{L}}}{\sigma_{\mathcal{L}}},$$

l is the number of the tested segment in the tested session, $r_i$, $\zeta(O_{r_i}^{(l)}|\Lambda_{r_p})$ is a log likelihood function of segment l of session $r_i$, relative to said preferred model, $\Lambda_{r_p}$, $\mu_\zeta$ is a mean of the log likelihood function of all segments is said session from which said preferred model is selected $r_p$, and $\sigma_\zeta^2$ is the variance of the log likelihood function of all segments is said session $r_p$.

13. A database of stored speech units developed by a process that comprises the steps of:

separating said stored speech units into sessions;

separating each session into segments;

analyzing each session to develop a speech model for the session;

selecting a preferred speech model from speech models developed in said step of analyzing;

identifying, by employing said preferred speech model, those of said segments that need to be altered; and altering those of said segments that are identified by said step of identifying.

14. The database of claim 13 where, in said process that creates said database, said step of altering comprised the steps of:

developing filter parameters for a segment that needs to be altered; and passing the speech units signal of said segment that needs to be altered through a filter that employs said filter parameters.

15. The database of claim 13 where, in said process that creates said database, said step of analyzing a session to develop a speech model for the session comprises the steps of:

selecting a sufficient number of segments from said session to form a speech portion of approximately ten minutes; and developing a speech model for said session based on the segments selected in said step of selecting.

16. The database of claim 13 where, in said process that creates said database, said step of analyzing a session to develop a speech model for the session comprises the steps of:

selecting a number of segments, K, from said session, where K is greater than a preselected number, where each segment includes a plurality of observations;

developing speech parameters for each of said plurality of observations; and developing a speech model for said session based on said speech parameters developed for observations in said selected segments of said session.

17. The database of claim 13 where, in said process that creates said database, said step of selecting a preferred speech model comprises the steps of:

developing a measure of speech quality variability within each session based on the speech model developed for the session by said step of analyzing; and selecting as the preferred model the speech model of the session with the least speech quality variability.

18. The database of claim 13 where, in said process that creates said database, said step of identifying segments that need to be altered comprises the steps of:

testing each of said segments against the hypothesis that the speech units in said segment conform to said preferred speech model.

19. The database of claim 18 where the hypothesis is accepted for a segment tested in said step of testing when the likelihood that a speech model that generated the speech units in the segment is said preferred speech model is higher than a preselected threshold level.

20. The database of claim 13 where the hypothesis is accepted for a segment tested in said step of testing when a z score for the segment tested in said step of testing, $z_{r_i}^{l}$, is greater than a preselected level, where $$z_{r_i}^{l} = \frac{\mathcal{L}(O_{r_i}^{(l)} \mid \Lambda_{r_p}) - \mu_{\mathcal{L}}}{\sigma_{\mathcal{L}}},$$

l is the number of the tested segment in the tested session, $r_i$, $\zeta(O_{r_i}^{(l)}|\Lambda_{r_p})$ is a log likelihood function of segment l of session $r_i$, relative to said preferred model, $\Lambda_{r_p}$, $\mu_{\zeta}$ is a mean of the log likelihood function of all segments is said session from which said preferred model is selected $r_p$, and $\sigma_{70}^2$ is the variance of the log likelihood function of all segments is said session $r_p$.

* * * * *